US006415632B1

(12) United States Patent
Vesnaver

(10) Patent No.: US 6,415,632 B1
(45) Date of Patent: Jul. 9, 2002

(54) METHOD FOR PRODUCING A KNITTED FABRIC WITH A CIRCULAR KNITTING MACHINE WITH CYLINDER AND DIAL, PARTICULARLY FOR PRODUCING FOOTLETS OR THE LIKE

(75) Inventor: Giuliano Vesnaver, Via Avis (IT)

(73) Assignee: Gafitex S.r.l., Guidizzolo (IT)

( * ) Notice: Subject to any disclaimer, the term of this patent is extended or adjusted under 35 U.S.C. 154(b) by 0 days.

(21) Appl. No.: 09/968,489

(22) Filed: Oct. 2, 2001

(30) Foreign Application Priority Data

Mar. 12, 2001 (IT) ..... MI2001A0518

(51) Int. Cl.[7] ..... D04B 9/46
(52) U.S. Cl. ..... 66/19; 66/185
(58) Field of Search ..... 66/185, 178 R, 66/186, 187, 194, 19–28; 2/239, 240

(56) References Cited

U.S. PATENT DOCUMENTS 4,277,959 A * 7/1981 Thorneburg ..... 66/182
5,560,226 A * 10/1996 Thorneburg ..... 66/182
5,603,232 A * 2/1997 Throneburg ..... 66/185
5,791,163 A * 8/1998 Thorneburg ..... 66/182
6,173,589 B1 * 1/2001 Hayes, Jr. et al. ..... 66/182
6,230,525 B1 * 5/2001 Dunlap ..... 66/182

* cited by examiner

*Primary Examiner*—Danny Worrell
(74) *Attorney, Agent, or Firm*—Guido Modiano; Albert Josif; Daniel O'Byrne

(57) ABSTRACT

A method for producing a knitted fabric with a circular knitting machine with cylinder and dial, particularly for producing footlets, comprising the steps of producing a knitted fabric with a particular process that achieves high elastic deformability for the fabric. By virtue of this high elastic deformability, the fabric is particularly adapted to be used to produce footlets, obtainable simply by cutting, from the fabric according to the invention, a contoured part, to which a pretensioned elastic band is applied at its perimeter. The resulting footlet has an elastic deformability that achieves optimum fit yet can have, on the side adapted to be directed toward the user's foot, an inextensible natural thread.

11 Claims, 2 Drawing Sheets

METHOD FOR PRODUCING A KNITTED FABRIC WITH A CIRCULAR KNITTING MACHINE WITH CYLINDER AND DIAL, PARTICULARLY FOR PRODUCING FOOTLETS OR THE LIKE

BACKGROUND OF THE INVENTION

The present invention relates to a method for producing a knitted fabric with a circular knitting machine with cylinder and dial, particularly for producing footlets or the like.

Footlets for protecting the foot inside shoes when, particularly during summer, one prefers not to wear socks are already known.

One type of footlet that is currently commercially available is produced starting from a piece of knitted fabric from which the parts that compose the footlet are cut and are then mutually assembled by sewing.

The operations for cutting and sewing the parts that compose the footlet significantly affect the production costs of this type of footlet. However, with the knitted fabrics currently commercially available for this application it is difficult to reduce the number of parts required without excessively penalizing the fit of the footlet, since said fabrics have a limited elasticity. Moreover, the stitched seams can cause discomfort to the user.

Another type of footlet is produced individually directly on circular machines with a process similar to the one used for making socks. In order to contain production costs, these footlets are generally produced in a single size, by using exclusively synthetic yarns that are highly extendible but are not always appreciated by the user, who generally prefers a natural material in contact with his skin. As an alternative, one resorts to additional sewing operations, but it becomes necessary to provide a plurality of sizes, inevitably increasing production costs.

SUMMARY OF THE INVENTION

The aim of the present invention is to solve the above noted problems, by providing a method that allows to produce a knitted fabric that is particularly adapted to be used to produce footlets or the like with lower production costs than required by current methods for producing these items.

Within this aim, an object of the invention is to provide a knitted fabric that allows to produce footlets that are particularly comfortable for the user.

Another object of the invention is to provide a knitted fabric that, although having a substantially inextensible natural yarn on one of its sides, has an elastic extendibility that allows to produce comfortable footlets without having to resort to the assembly of shaped parts and with a reduced number of sizes in production.

This aim and these and other objects that will become better apparent hereinafter are achieved by a method for producing a knitted fabric with a circular knitting machine with cylinder and dial, particularly for producing footlets or the like, comprising the steps of:

- producing a first row of knitting by using all the needles of the cylinder, forming drop stitches and keeping the needles of the dial inactive;
- producing a second row of knitting by using every other needle of the dial and every other needle of the cylinder, forming tuck stitches;
- producing a third row of knitting by using the same needles of the dial used to form the second row of knitting, forming drop stitches and keeping inactive the other needles of the cylinder and of the dial;
- producing a fourth row of knitting by using all the needles of the cylinder, forming drop stitches and keeping the needles of the dial inactive;
- producing a fifth row of knitting by using the needles of the cylinder and of the dial that have not been used in forming said second row of knitting, forming tuck stitches and keeping inactive the other needles of the cylinder and of the dial;
- producing a sixth row of knitting by using the same needles of the dial used to form the fifth row of knitting, forming drop stitches and keeping inactive the other needles of the dial and the needles of the cylinder;

said production steps being repeated for the successive rows of knitting, using elastically extendible yarns to form at least part of the rows of knitting.

BRIEF DESCRIPTION OF THE DRAWINGS

Further characteristics and advantages of the invention will become better apparent from the description of a preferred but not exclusive embodiment of the method according to the invention, illustrated only by way of nonlimitative example in the accompanying drawings, wherein.

DESCRIPTION OF THE PREFERRED EMBODIMENTS

The method according to the invention is performed with a circular knitting machine with cylinder and dial, with a plurality of feeds or drops.

Preferably, the machine has a number of drops that is a multiple of six, but the number of drops can also be different.

The machine allows, in a per se known manner, to actuate in a different manner, at a drop, one needle with respect to the contiguous needle both in the cylinder and in the dial.

This can be achieved by means of appropriate selection devices and/or by adopting particular cams and needles, which are also of a known type.

In the illustrated case, long needles alternated with short needles are provided in the cylinder. The needles have, in a per se known manner, heels that protrude from the curved surface of the cylinder and engage paths or tracks formed by cams that laterally face the cylinder.

Long needles alternated with short needles are provided in the dial as well. The dial needles, too, have heels that protrude upward from the dial and engage paths or tracks formed by cams that face the dial in an upward region.

Figure 2:
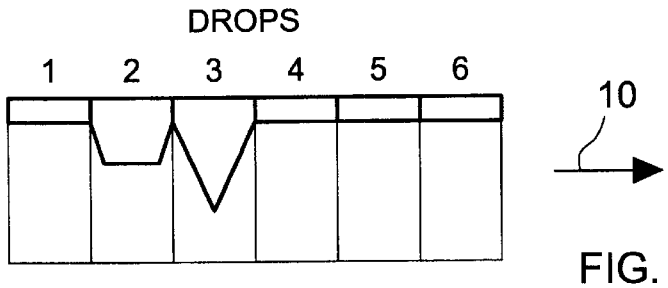
FIGS. 2 and 3 are schematic Views of the actuation paths, arranged along a rectilinear direction, of the needles of the dial.

FIG. 2 illustrates the path traced by the heels of the long needles of the dial at the six drops, used to form six rows of knitting in succession, designated by the reference numerals 1 to 6.

Figure 3:
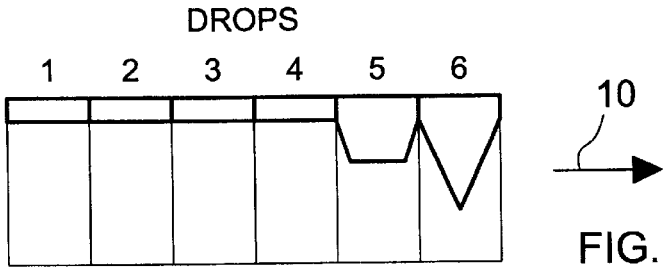

FIG. 3 illustrates the path traced by the heels of the short needles of the dial at the six drops.

Figure 4:
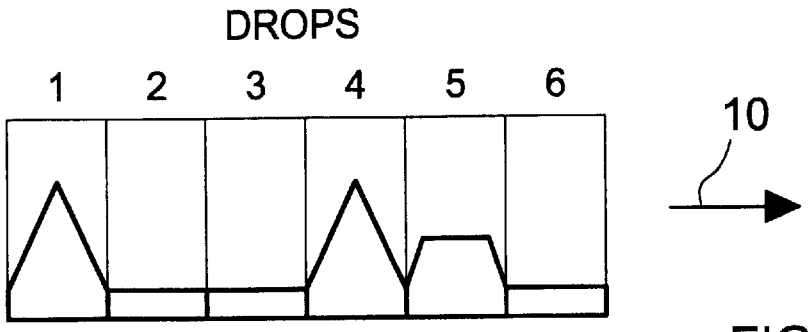
FIGS. 4 and 5 are schematic views of the actuation paths of the needles of the cylinder, projected flat.

FIG. 4 illustrates the path traced by the heels of the short needles of the cylinder at the six drops.

Figure 5:
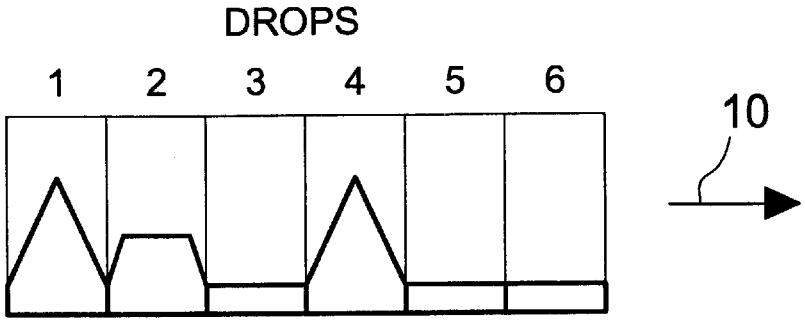
Figure 6:
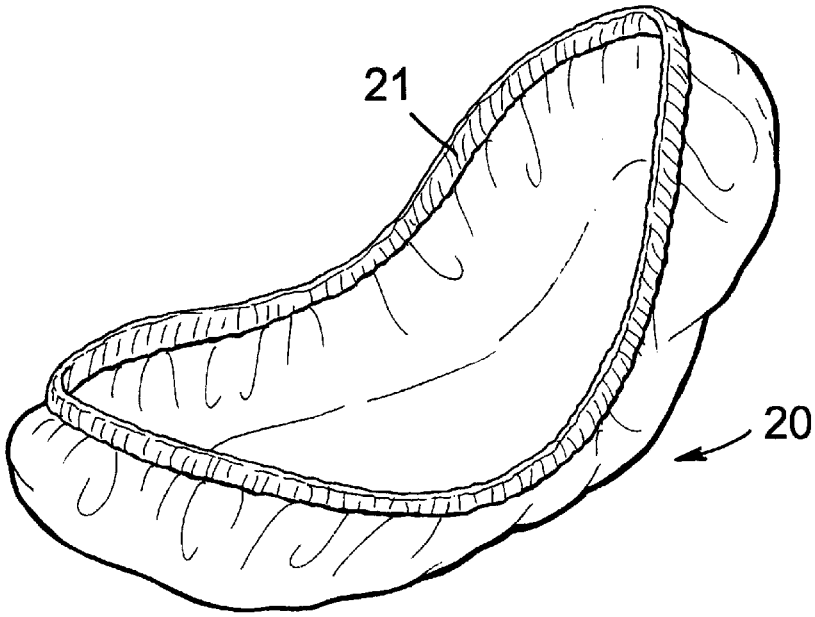
FIG. 6 is a view of a footlet obtained with a method according to the invention.

FIG. 5 is a view of the path traced by the heels of the long needles of the cylinder at the six drops.

In the various figures, the movement of the cylinder and of the dial with respect to the needle actuation cams is indicated by the arrow 10.

Figure 1:
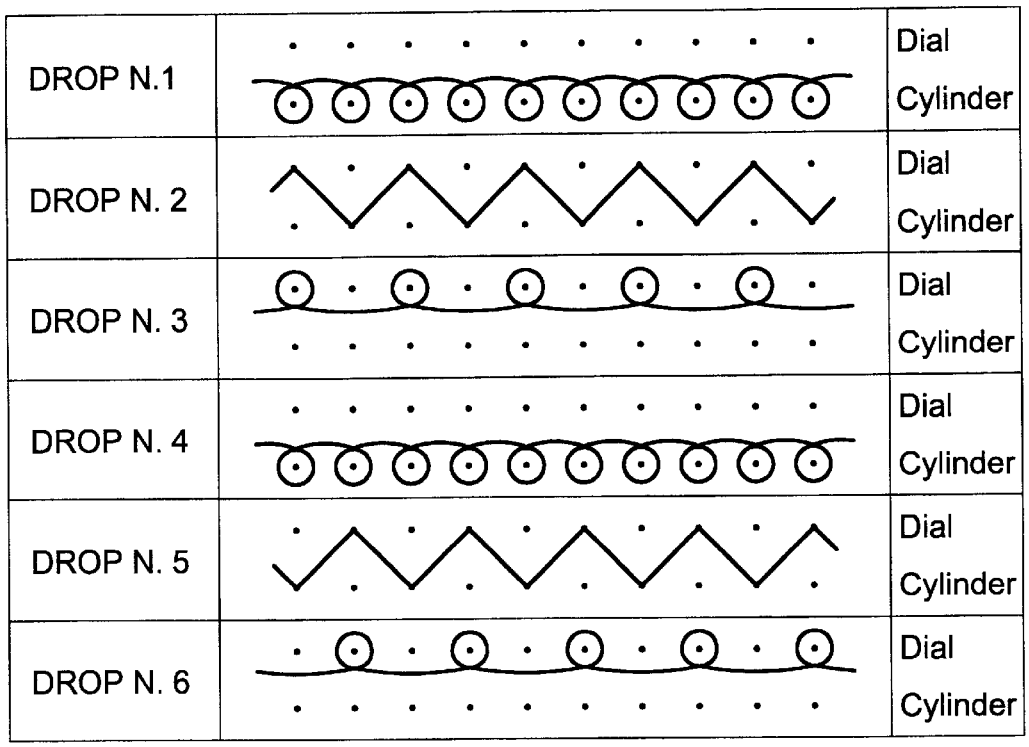
FIG. 1 is a view of the method according to the invention, showing exclusively the formation of six rows of knitting in succession, represented according to the Tramelloni model.

FIG. 1 schematically shows, according to the Tramelloni model, the is actuation of the needles of the cylinder and of the dial drop by drop, in the six drops being considered.

The needles are schematically represented by dots and the needles of the dial are arranged above the needles of the cylinder.

In the execution of the method according to the invention, all the needles of the cylinder are made to knit at the drop 1 and are actuated so as to form drop stitches. The needles of the cylinder, following the path shown in FIGS. 4 and 5, are all raised so as to engage the yarn dispensed at the drop 1, lowering onto their shank the loops of knitting formed earlier in any preceding knitting step, and are then lowered to form a new loop of knitting, releasing the preceding loop of knitting, which is thus knitted in with the new one.

The needles of the dial are not used at the drop 1.

Preferably, the yarn knitted at the drop 1 is a cotton yarn.

Only the long needles of the cylinder and of the dial are used at the drop 2, while the short needles are left inactive.

Substantially, a row of knitting is formed at the drop 2 by using every other needle in the cylinder and in the dial. The actuated needles are raised, in the case of the cylinder, and extracted, in the case of the dial, in order to engage the yarn dispensed at the drop 2 to an extent that is less than required to lower onto the shank of the needle the previously formed loop of knitting. The actuated needles thus form tuck stitches.

Preferably, the yarn supplied at the drop 2 is an elastically extendible yarn, made for example of nylon.

The needles of the dial that have knitted at the drop 2 knit at the drop 3 and form drop stitches. The other needles of the dial and all the needles of the cylinder are excluded from knitting.

Preferably, the yarn knitted at the drop 3 is an elastically extendible yarn made for example of nylon.

All the needles of the cylinder are actuated at the drop 4, forming drop stitches and keeping the needles of the dial inactive.

Preferably, the yarn knitted at the drop 4 is a cotton yarn.

The short needles of the cylinder and of the dial knit at the drop 5.

Substantially, a row of knitting is formed at the drop 5 by using every other needle both in the cylinder and in the dial, as at the drop 2, but by swapping the needles. The long needles in fact are not actuated. The short needles are actuated in the manner in which the long needles of the drop 2 were actuated, i.e., forming tuck stitches.

Preferably, the yarn knitted at the drop 5 is an elastically extendible yarn made for example of nylon.

The short needles of the dial, i.e., the needles that knitted at the drop 5, are actuated at the drop 6 and form drop stitches. The other needles of the dial and the needles of the cylinder are kept inactive.

Preferably, the yarn knitted at the drop 6 is an elastically extendible yarn, made for example of nylon.

Knitting then continues by repeating the described steps, from the drop 1 onward, resuming from drop 1 or continuing from the seventh drop and so forth in order to obtain the fabric particularly adapted to produce footlets or the like.

The fabric obtained with the method according to the invention in fact has high elastic deformability, although it can have a cotton yarn on one of its sides, which will become the inner side of the footlet.

This elastic deformability allows to form footlets monolithically with reduced production costs and ensures an excellent fit of the footlet.

More particularly, the fabric produced with the method according to the invention is cut into shapes adapted to obtain the footlets 20. A pretensioned elastic border 21 is then applied by sewing to the perimeter of each shaped part obtained by cutting and achieves the characteristic shape for the footlet 20.

Before contoured cutting, the fabric can be subjected to other conventional treatments, such as for example thermal setting of the lap, longitudinal cutting to open the tubular item, et cetera.

In practice it has been observed that the method according to the invention fully achieves the intended aim and objects, since it allows to obtain a fabric that can be used in particular to produce footlets that have an excellent fit, with reduced production costs with respect to those required by known methods.

The method thus conceived is susceptible of numerous modifications and variations, all of which are within the scope of the inventive concept; all the details may furthermore be replaced with other technically equivalent elements.

In practice, the materials employed, so long as they are compatible with the specific use, as well as the dimensions, may be any according to requirements and to the state of the art.

The disclosures in Italian Patent Application No. MI2001A000518 from which this application claims priority are incorporated herein by reference.

What is claimed is:

1. A method for producing a knitted fabric with a circular knitting machine with cylinder and dial, for producing footlets, comprising the steps of:

producing a first row of knitting by using all the needles of the cylinder, forming drop stitches and keeping the needles of the dial inactive;

producing a second row of knitting by using every other needle of the dial and every other needle of the cylinder, forming tuck stitches;

producing a third row of knitting by using the same needles of the dial used to form the second row of knitting, forming drop stitches and keeping inactive the other needles of the cylinder and of the dial;

producing a fourth row of knitting by using all the needles of the cylinder, forming drop stitches and keeping the needles of the dial inactive;

producing a fifth row of knitting by using the needles of the cylinder and of the dial that have not been used in forming said second row of knitting, forming tuck stitches and keeping inactive the other needles of the cylinder and of the dial;

producing a sixth row of knitting by using the same needles of the dial used to form the fifth row of knitting, forming drop stitches and keeping inactive the other needles of the dial and the needles of the cylinder;

this succession being repeated for the successive rows of knitting, using elastically extendible yarns to form at least part of the rows of knitting.

2. The method according to claim 1, wherein said first row of knitting is formed by means of a cotton yarn.

3. The method according to claim 1, wherein said second row of knitting is formed with an elastically extendible yarn.

4. The method according to claim 1, wherein said third row of knitting is formed with elastically extensible yarn.

5. The method according to claim 1, wherein said fourth row of knitting is formed with a cotton yarn.

6. The method according to claim 1, wherein said fifth row of knitting is formed with an elastically extendible yarn.

7. The method according to claim 1, wherein said sixth row of knitting is formed with an elastically extendible yarn.

8. A knitted fabric particularly for forming footlets obtained with the method according to claim 1.

9. A method for producing footlets, comprising the steps of providing a knitted fabric with the method according to claim 1, cutting portions, according to preset shapes, of said knitted fabric, and applying perimetrically to each one of said portions a pretensioned elastically extensible border.

10. The method according to claim 9, wherein before said portions are cut said fabric is subjected to rim heat setting.

11. A footlet obtained with the method according to claim 9.

* * * * *